US005503170A

United States Patent [19]

Roberts

[11] Patent Number: 5,503,170

[45] Date of Patent: Apr. 2, 1996

[54] COMBINATION APPLICATOR-DISPENSER HAIR STYLER

[76] Inventor: Shephard D. Roberts, 185-03 Dunlop Ave., Saint Albans, Queens, N.Y. 11412

[21] Appl. No.: 834,589

[22] Filed: Feb. 12, 1992

[51] Int. Cl.[6] ..... A45D 2/22; A45D 6/14

[52] U.S. Cl. ..... 132/227; 132/252; 132/226

[58] Field of Search ..... 132/227, 228, 132/221, 249, 270, 902, 226, 112, 223, 252, 210, 245; D28/35, 37

[56] References Cited

U.S. PATENT DOCUMENTS

| | | | |
|---|---|---|---|
| 4,011,879 | 3/1977 | Roberts | 132/227 |
| 4,388,936 | 6/1983 | Roberts | 132/227 |
| 4,938,621 | 2/1995 | Pyrozyk | 132/112 |

*Primary Examiner*—John G. Weiss
*Attorney, Agent, or Firm*—Henry M. Feiereisen

[57] ABSTRACT

A hair applicator-dispenser has a container with a pressurized preparation applied to hair for treatment thereof. The container has a rectangular triple roller dome-head receptacle and is connectable to a removable rectangular hair curler which includes a roller arrangement in form of a central roller and two side rollers. The central roller has a plurality of apertures axially disposed circumferentially spaced for applying the contents of the container onto hair for a particular treatment. A clasp is placeable over the roller arrangement to form a combination hair curler-wave. The hair curler serves as a hair roller on which hair can be rolled and the clasp is slipped on axially over the hair to hold the latter in place. The container is a multiple choice spray dispenser, and can also be used without the roller attachments.

15 Claims, 1 Drawing Sheet

COMBINATION APPLICATOR-DISPENSER HAIR STYLER

BACKGROUND OF THE INVENTION

This invention relates generally to treatment of hair and more particularly to a new and improved applicator-dispenser.

Applicator-dispensers used for hair stimulants and hair growers and the like are known, e.g. from my U.S. Pat. No. 4,011,879 and U.S. Pat. No. 4,388,936. The device disclosed therein has a dispenser with an applicator top or cover used generally for treatment of hair. The contents thereof may be for example, a hair stimulant or grower for growing hair. Moreover, hair rollers of all types of construction are known.

SUMMARY OF THE INVENTION

The principal object of the present invention is to provide a new and improved combination applicator-dispenser hair styler useable as a hair curler.

Another object of the present invention is the provision of a reusable container which can be filled and refilled with preparation by the user.

It is also another object of this invention to provide a changeability feature to a spray-only type container for special styling or spraying of hair.

It is a further object of the invention to provide a built-in mechanism and control of the contents within the container for release and outward flow, similar to my U.S. Pat. No. 4,388,936.

These objects and others which will become apparent hereinafter, are attained in accordance with the present invention by providing a hair curler with a roller arrangement in form of three rollers and a clasp of complementary configuration which is placed over the roller arrangement. Suitably, the hair curler is detachably secured to a durable spray container which includes a preparation for application to hair and accommodates a release mechanism in form of a spring-biased push lever for directing the preparation to the hair curler from where the preparation exits via apertures upon the central roller of the roller arrangement.

The hair curler is provided in form of a removable tubular and pliable roller arrangement and securable to a sleeve or dome-like portion of the container. The roller arrangement has a plurality of axial apertures for dispensing of contents of hair treatment preparation and is of such configuration that the preparation is directed via internal flanges and platforms to the apertures when activated by the push lever.

The roller arrangement is provided with three adjacent circular smooth rollers at formation of a V-shaped recess at the junction between neighboring rollers for holding hair strands subsequent to application of the preparation for styling. The rollers have rounded edges and hold the hair strands securely when hair is twisted or wrapped around the smooth roller surfaces, and the clasp is attached over the roller arrangement. The horizontal sides of the clasp press against the V-shaped recesses to close the open spaces between the sides and recesses so that dispensed preparation exits all apertures or holes and flows onto the rolled hair upon actuation of the push lever.

The applicator-dispenser is provided with a removable clasp which is placed axially over the hair curler for holding the hair onto the roller arrangement. This clasp is open at both ends and is rectangularly shaped and holds the hair tightly against the hair-roller arrangement for quick curling with waves and styling.

When not in use, the hair curler and clasp are either retained on the container or removed for securement of a plain top cover screw-on cap.

A fine pin-hole top may also be detachably secured to the container for allowing spraying of the hair with preparation or for scalp massage.

BRIEF DESCRIPTION OF THE DRAWINGS

The above and other objects of the dispenser-applicator according to the invention will be readily evident upon the study of the following specification, claims and accompanying drawings in which:

DESCRIPTION OF THE PREFERRED EMBODIMENTS

Figure 1:
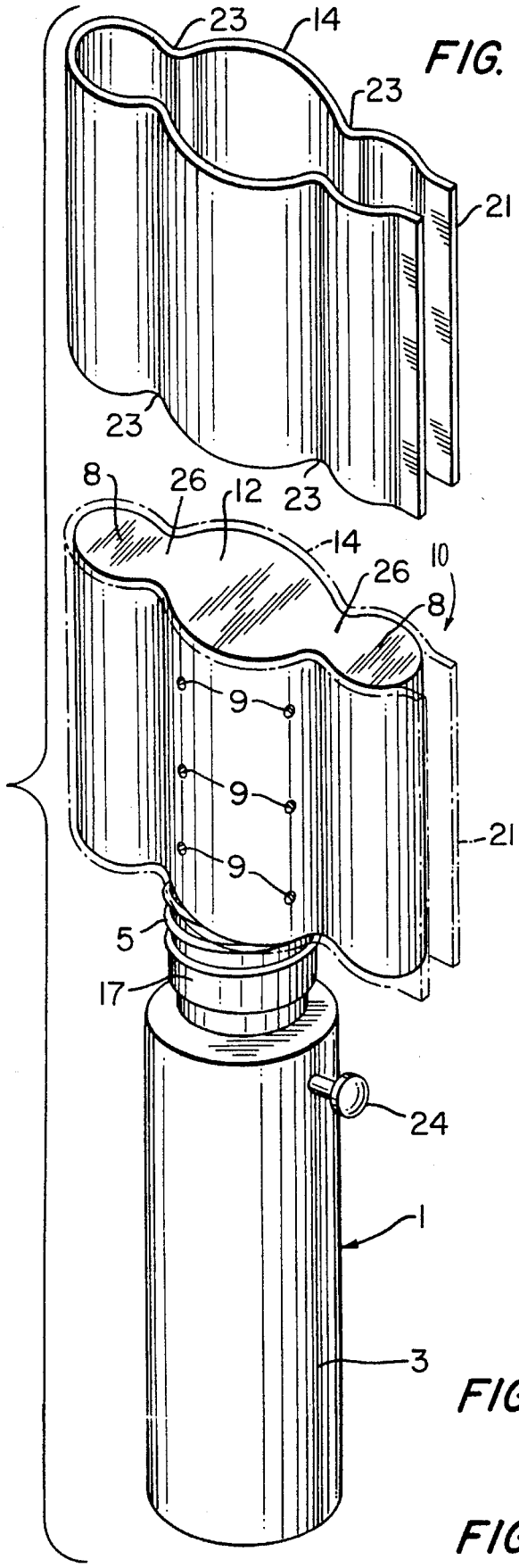
FIG. 1 is an elevational, exploded side view of an applicator-dispenser according to the present invention, with removed clasp.
Figure 2:
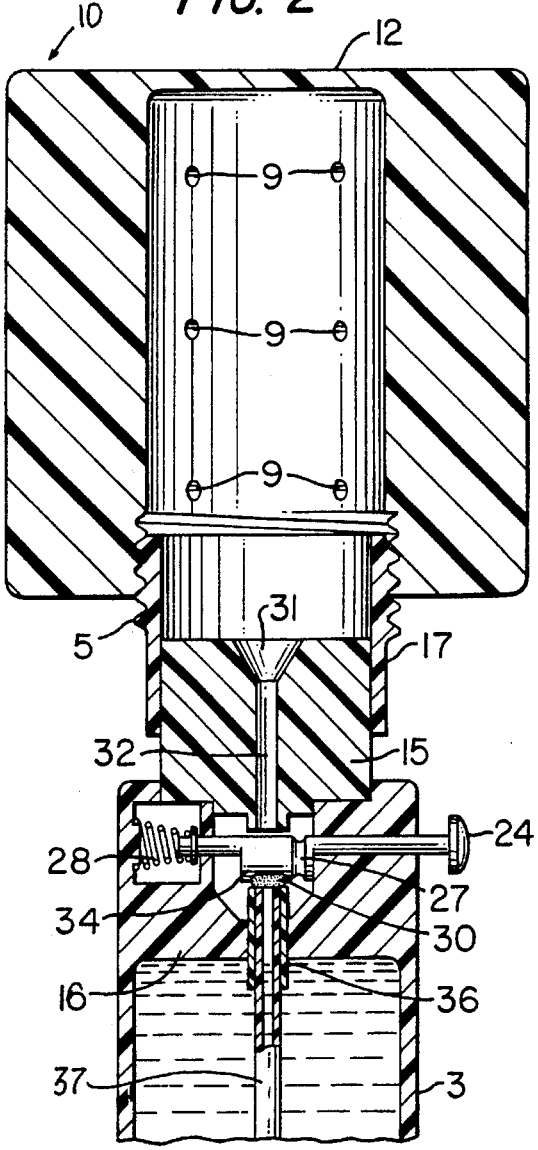
FIG. 2 is a fragmentary sectional view of the applicator-dispenser of FIG. 1.

An applicator-dispenser 1 according to the invention comprises a durable upright container 3 made of plastic, metal or similar combination of materials with required bursting and sealing strength and containing pressurized liquid hair treatment preparation, e.g. a hair conditioner, pressing oil, lotion or hair straighter oil, for application on the hair strands when actuating a release mechanism in form of an push lever 24, as will be explained furtherbelow. The container has a substantially solid top portion 16 with an upper recess for snugly receiving a plug 15 projecting from the container 3. Placed over the plug 15 is a sleeve 17 which includes an external threading 5 for attachment of a hair curler, generally designated by reference numeral 10 via a meshing internal threading. The hair curler 10 has a side roller arrangement in form of three rollers with a central roller 12 and two side rollers 8. The central roller 12 is provided with axially spaced apertures 9 through which the content of the dispenser is applied and is open at one end facing the container 3 to allow preparation to flow from the container 3 into the central roller 12 and out through the apertures 9.

The central roller 12 is of larger diameter than the diameter of the two side rollers 8 so that V-shaped recesses 26 are defined at the junction between each side roller 8 and the central roller 12. The side rollers 8 serve to hold the hair more evenly against the V-shaped recesses 26 when the preparation is applied from the dispenser. Placed over the roller arrangement 8, 12 of the hair curler 10 is a clasp 14 of a configuration complementary to the roller arrangement 8, 12 as shown in FIG. 1 in dash-dot line.

The hair curler 10 is of rectangular shape and can be used as a triple hair roller on which hair is twisted or wrapped around for hair styling to assist in holding the hair in position on the roller arrangement. The clasp 14 is placed axially over the roller arrangement 8, 12 to grip hair strands securely in the manner of a clip or clamp. In order to provide an easy fitting onto the roller arrangement 8, 12, the clasp 14 is provided at one end with an axial slot 21 which extends from the open top lengthwise to the open bottom 23 as seen in FIG. 1. The slot 21 allows a radial or outward expansion of the clasp 14 as it is pressed on and over the hair on the hair curler 10 for development of a combination curl and wave and the like.

The container 3 accommodates a vertical capillary tube 37 which is received at the top in a sleeve 36. Placed upon the rim of the sleeve 36 is a protuberant lid 30 which is secured to a globular toggle 34 of a push lever 24 and seals the tube 37. The push lever 24 is biased at one end by a spring 28 and includes a circumferential groove 27 at a slight distance to the lid 30. The release mechanism is described in my earlier U.S. Pat. No. 4,388,936.

Upon actuation of the lever 24, the lid 30 is shifted to the left in opposition to the force exerted by the spring 28. When the groove 27 is in alignment with the tube 37, liquid flows upward through the tube 37 via the groove 27 into an upper vertical tube 32 which is set within the plug 15 and is also in alignment with the groove 27. The tube 32 is provided at the end distant to the groove with a funnel 31 via which liquid released from the container 3 enters into the central roller 12 and is dispensed through the apertures 9. The funnel 31 serves also to collect any drip-back liquid for return to the tube 32.

After the contents of the container have been expended, the container may be retained for refilling. Those in the art will know that the package may also include additional hair curlers made in a similar as an initial supply; of curlers and covers.

Figure 3:
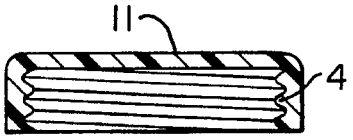
FIG. 3 is a sectional view of a plain top screw-on cap for attachment to the applicator-dispenser of FIG. 1.
Figure 4:
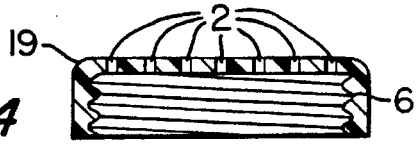
FIG. 4 is a sectional view of a pin-hole top screw-on cap for attachment to the applicator-dispenser of FIG. 1.

After use, the hair curler 10 may be detached from the container 3 which is then sealed by a screw-on cap 11 which has an internal threading meshing with the external threading 5 of the plug 15, as shown in FIG. 3. FIG. 4 shows a screw-on cap 19 which has a top provided with perforations 2 to allow spraying of preparation onto hair. Reference numeral 6 designates the internal threading for engagement with the threading 5 of the plug 15.

While the invention has been illustrated and described as embodied in a combination applicator-dispenser hair styler, it is not intended to be limited to the details shown since various modifications and structural changes may be made without departing in any way from the spirit of the present invention.

What is claimed as new and desired to be protected by Letters Patent is set forth in the appended claims:

1. A hair treatment applicator-dispenser; comprising:

a container containing a preparation usuable for application to hair;

actuation means arranged in said container for controlling flow of the preparation through said container;

a hair curler detachably secured to said container and having a roller arrangement for wrapping hair therearound, said roller arrangement having a central roller and two adjoining rollers connected laterally to said central roller such that a recess is formed at a junction between the central roller and each of said adjoining rollers to configure said roller arrangement with a wave-type motion, said central roller being provided with apertures in communication with said container for receiving preparation and dispensing preparation in direction toward said recesses; and a clasp removably mounted over said roller arrangement to hold hair wrapped around said rollers in place.

2. A hair treatment applicator-dispenser according to claim 1 wherein said container has an open top, further comprising a plug for closing said top and attachment of said hair curler.

3. A hair treatment applicator-dispenser according to claim 2 wherein said roller arrangement has a sleeve-like extension for engagement over said plug.

4. A hair treatment applicator-dispenser according to claim 1 wherein said central roller is open on one end and closed on an opposite end and is of larger dimensions than dimensions of said other rollers.

5. A hair treatment applicator-dispenser according to claim 1 wherein said center roller is of tubular configuration.

6. A hair treatment applicator-dispenser according to claim 1 wherein said recesses between said central roller and said laterally adjoining rollers are of V-shaped configuration.

7. A hair treatment applicator-dispenser according to claim 6 wherein said V-shaped recess extends lengthwise to form a gully-like configuration.

8. A hair treatment applicator-dispenser according to claim 1 wherein said clasp has an axial opening extending at one end thereof from top to bottom.

9. A hair treatment applicator-dispenser according to claim 1 wherein said container is made of a material selected from the group consisting of plastic material, metal and a combination thereof with sufficient bursting and sealing characteristics to withstand a pressure exerted by said preparation.

10. A hair curler, comprising:

a roller arrangement for wrapping hair therearound, said roller arrangement having a central roller and two adjoining rollers connected laterally to said central roller such that a recess is formed at a junction between the central roller and each of said adjoining rollers to configure said roller arrangement with a wave-type motion, said central roller being provided with apertures in communication with a container for receiving a preparation and dispensing preparation in direction toward said recesses; and a clasp removably mounted over said roller arrangement to hold hair wrapped around said rollers in place.

11. A hair curler according to claim 10 wherein said central roller is open on one end and closed on an opposite end and is of larger dimensions than dimensions of said other rollers.

12. A hair curler according to claim 10 wherein said center roller is of tubular configuration.

13. A hair curler according to claim 10 wherein said recesses between said central roller and said laterally adjoining rollers are of V-shaped configuration.

14. A hair curler according to claim 13 wherein said V-shaped recess extends lengthwise to form a gully-like configuration.

15. A hair curler according to claim 10 wherein said clasp has an axial opening extending at one end thereof from top to bottom.

* * * * *